US012268345B1

(12) United States Patent
Imdorf

(10) Patent No.: US 12,268,345 B1
(45) Date of Patent: Apr. 8, 2025

(54) FACIAL PORE CLEANER, EXFOLIATOR, AND MASSAGER

(71) Applicant: Terrance Imdorf, Phoenix, AZ (US)

(72) Inventor: Terrance Imdorf, Phoenix, AZ (US)

( * ) Notice: Subject to any disclaimer, the term of this patent is extended or adjusted under 35 U.S.C. 154(b) by 0 days.

(21) Appl. No.: 18/796,616

(22) Filed: Aug. 7, 2024

(51) Int. Cl.
*A47K 7/02* (2006.01)

(52) U.S. Cl.
CPC ..... *A47K 7/028* (2013.01)

(58) Field of Classification Search
CPC ..... A47L 13/12; A47K 7/043; A47K 7/04; A47K 7/028; A47K 7/026; A47K 7/02; A47K 7/022
USPC ..... 15/105, 111, 113, 160
See application file for complete search history.

(56) References Cited

U.S. PATENT DOCUMENTS

| | | | | |
|---|---|---|---|---|
| D152,933 | S * | 3/1949 | Watson | D28/99 |
| 4,427,001 | A | 1/1984 | Kiefer et al. | |
| 4,520,799 | A | 6/1985 | Kruger | |
| 5,395,380 | A | 3/1995 | Berkovich | |
| 7,951,106 | B1 | 5/2011 | Perez et al. | |
| 9,060,583 | B2 | 6/2015 | Barraclough et al. | |
| 2009/0177210 | A1 | 7/2009 | Durso | |
| 2011/0046638 | A1 | 2/2011 | Gartstein et al. | |
| 2014/0137352 | A1 | 5/2014 | Golla et al. | |
| 2017/0079676 | A1 | 3/2017 | Ceto et al. | |
| 2018/0140317 | A1 | 5/2018 | Richardson | |

FOREIGN PATENT DOCUMENTS

| | | |
|---|---|---|
| WO | 2014055007 | 4/2014 |
| WO | 2020109307 | 6/2020 |

OTHER PUBLICATIONS

"Scrub buddy", webpage <https://www.dreamboxbeauty.com/products/scrub-buddy>, retrieved from Internet Archive Wayback Machine <https://web.archive.org/web/20231130050825/https://www.dreamboxbeauty.com/products/scrub-buddy> on Aug. 6, 2024.

"Amazon_IETONE 2 Pcs Stainless Steel Facial Pore Cleaner Scraper", webpage <https://www.amazon.com/IETONE-Stainless-Double-Head-Blackhead-Accessories/dp/B0B4P9WGZB?ref_=ast_sto_dp>, retrieved from Internet Archive Wayback Machine <https://web.archive.org/web/20240203093250/https://www.amazon.com/IETONE-Stainless-Double-Head-Blackhead-Accessories/dp/B0B4P9WGZB?ref_=ast_sto_dp> on Aug. 6, 2024.

* cited by examiner

*Primary Examiner* — Tom Rodgers
(74) *Attorney, Agent, or Firm* — Examiners Edge; Gary ONeill

(57) ABSTRACT

A manipulable hygiene device having a plurality of opposing blades and surfaces each including arrays of minute protruding structures distributed across the surface areas such that each array of minute protruding structures forms a collection of abrasive surfaces having varied contoured dimensions in a manipulable hygiene device which is manipulable by a user for abrasive hygiene. Abrasive hygiene includes at least hygiene activities such as brushing, scaling, cleaning, buffing, smoothing, rubbing, massaging, stimulating, shaving, scraping, squeegee, depilatories, wiping, spreading, and similar activities employing abrasion or frictional actions.

8 Claims, 3 Drawing Sheets

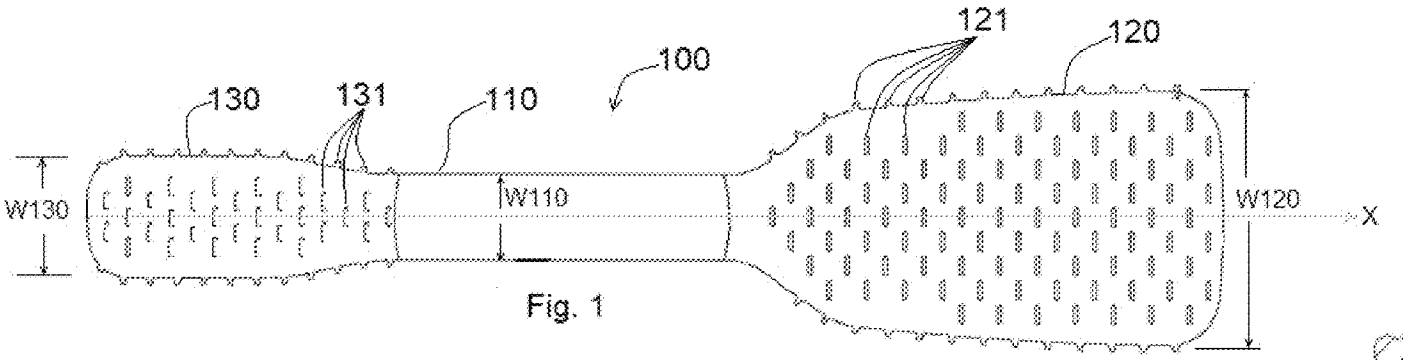
Fig. 1
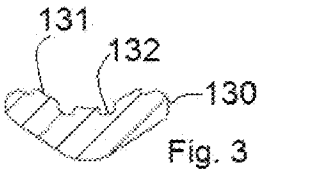
Fig. 3
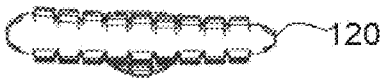
Fig. 4
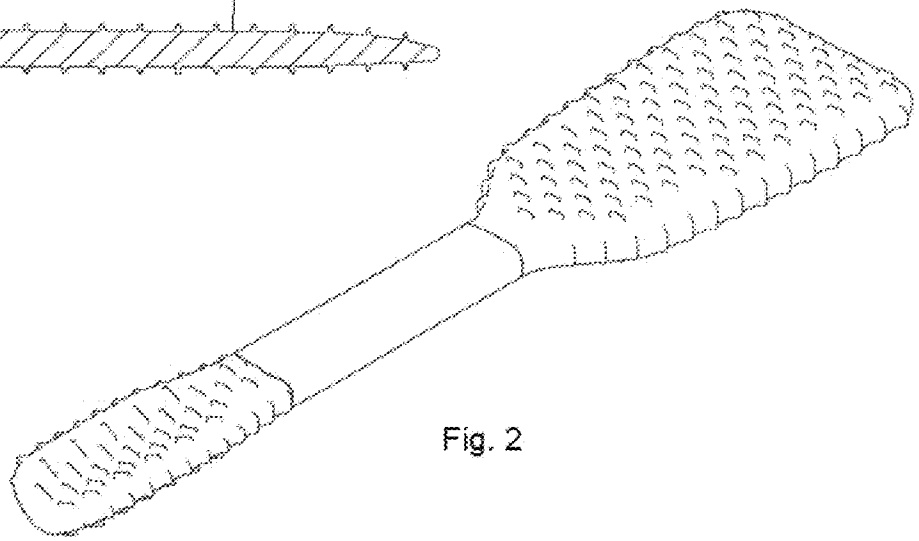
Fig. 2
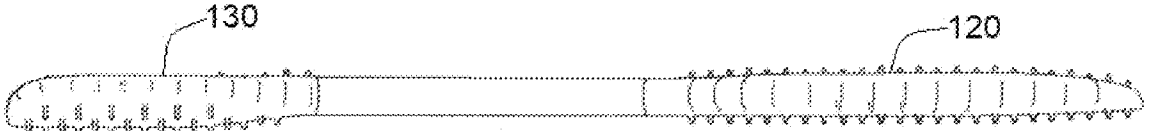
Fig. 5
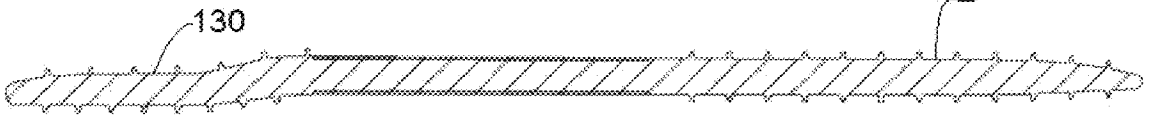
Fig. 6
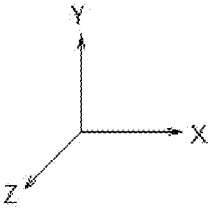

FACIAL PORE CLEANER, EXFOLIATOR, AND MASSAGER

CROSS-REFERENCE TO RELATED APPLICATIONS

N/A

BACKGROUND OF THE INVENTION

Hygiene habits are important for maintaining healthy lifestyles for both humans and animals. Various methods of hygiene are known in the prior art including assistive devices which may be used with or without fluids such as water, lotions, perfumes, colognes, or oils during use. While various hygiene assistive devices are known and used by humans, the commonly used hygiene assistive devices are inadequate for easily reaching and cleaning or massaging all portions of the body due to various curvatures and crevices which are present along a circumference of a body. Therefore, it would be desirable to develop a universally applicable hygiene assistive device which may be used for virtually any hygiene activity for human or an animal. Disclosed herein is a manipulable hygiene device which may be manipulated by a user either manually or automatically as a powered device for the purpose of accomplishing a hygiene activity.

SUMMARY OF THE INVENTION

The following provides a summary of certain exemplary embodiments of the present invention. This summary is not an extensive overview and is not intended to identify key or critical aspects or elements of the present invention or to delineate its scope. However, it is to be understood that the use of indefinite articles in the language used to describe and claim the present invention is not intended in any way to limit the described system. Rather the use of "a" or "an" should be interpreted to mean "at least one" or "one or more".

In accordance with one aspect of the present invention, a manipulable hygiene device is provided. The manipulable hygiene device includes an elongated stem positioned between a plurality of opposing blades, said elongated stem having a substantially constant width along an elongated axial direction; the plurality of opposing blades including a first blade attached to a proximal end of said elongated stem, said first blade having a varying width along said elongated axial direction; and the plurality of opposing blades including a second blade attached to a distal end of said elongated stem, said second blade having a varying width along said elongated axial direction; wherein said first blade and said second blade have a plurality of at least four surfaces respectively including at least an upper surface, a lower surface, a left surface and a right surface for each of said first and second blades; and each of the plurality of first and second respective blade surfaces further including an array of minute protruding structures distributed across substantially the entire surface area of each of the plurality of first and second respective blade surfaces such that each array of minute protruding structures forms a collection of abrasive surfaces having varied contoured dimensions in a manipulable hygiene device, said device manipulable by a user for abrasive hygiene.

In accordance with a second aspect of the present invention, the manipulable hygiene device further includes wherein said width of each of said first blade having a varying width along said elongated axial direction and said second blade having a varying width along said elongated axial direction have their respective smallest widths adjacent to their respective attachment ends of said elongated stem.

In accordance with a third aspect of the present invention, the manipulable hygiene device further includes wherein a width of said first blade having a varying width along said elongated axial direction varies to a greater extent than a width of said second blade having a varying width along said elongated axial direction.

In accordance with a fourth aspect of the present invention, the manipulable hygiene device further includes wherein said array of minute protruding structures distributed across substantially the entire surface area of each of the plurality of first and second respective blade surfaces are arranged in an array of rows and columns wherein each row is positionally offset from a set of most adjacent rows and each column is offset from a set of most adjacent columns.

In accordance with a fifth aspect of the present invention, the manipulable hygiene device further includes wherein said array of minute protruding structures distributed across substantially the entire surface area of each of the plurality of first and second respective blade surfaces are arranged in an array of randomly distributed positions with respect to adjacent minute protruding structures.

In accordance with a sixth aspect of the present invention, the manipulable hygiene device further includes wherein said array of minute protruding structures distributed across substantially the entire surface area of each of the plurality of first and second respective blade surfaces each have a polygonal or an arcuate cross-sectional area.

In accordance with a seventh aspect of the present invention, the manipulable hygiene device further includes wherein the plurality of opposing blades including a first blade and a second blade are aligned in the elongated axial direction such that said plurality of opposing blades lie within the same plane as said elongated stem.

In accordance with a eighth aspect of the present invention, the manipulable hygiene device further includes wherein the plurality of opposing blades including a first blade and a second blade are offset with respect to the elongated axial direction such that at least one of said plurality of opposing blades does not lie within the same plane as said elongated stem.

In accordance with a ninth aspect of the present invention, the manipulable hygiene device further includes wherein the plurality of opposing blades including a first blade and a second blade includes at least one blade which is convex or concave in an orthogonal direction with respect to the elongated axial direction.

In accordance with a tenth aspect of the present invention, the manipulable hygiene device further includes wherein the plurality of opposing blades including a first blade and a second blade includes at least one blade which is substantially convex, concave, or planar in profile in an orthogonal direction with respect to the elongated axial direction and said array of minute protruding structures distributed across substantially the entire surface area of each of the plurality of first and second respective blade surfaces protrudes orthogonally from the respective blade surfaces having substantially convex, concave, or planar profiles.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF DRAWINGS

The accompanying drawings, which are incorporated into and form a part of the specification, schematically illustrate one or more exemplary embodiments of the invention and, together with the general description given above and detailed description given below, serve to explain the principles of the invention, and wherein:

FIG. 1 is a perspective view of a manipulable hygiene device in accordance with an exemplary embodiment of the present invention;

FIG. 2 is another perspective view of a manipulable hygiene device in accordance with an exemplary embodiment of the present invention;

FIG. 3 is a first end view of a manipulable hygiene device in accordance with an exemplary embodiment of the present invention;

FIG. 4 is a second end view of a manipulable hygiene device in accordance with an exemplary embodiment of the present invention;

FIG. 5 is a side view of a manipulable hygiene device in accordance with one embodiment of the present invention;

FIG. 6 is a side view of a manipulable hygiene device in accordance with another embodiment of the present invention;

DETAILED DESCRIPTION OF THE INVENTION

Figure 7:
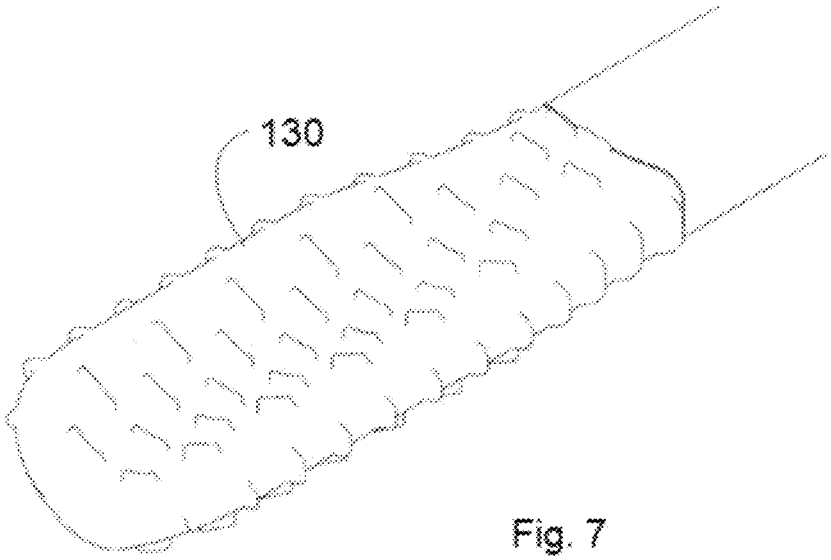
FIG. 7 is a second blade view of a manipulable hygiene device in accordance with one embodiment of the present invention.
Figure 8:
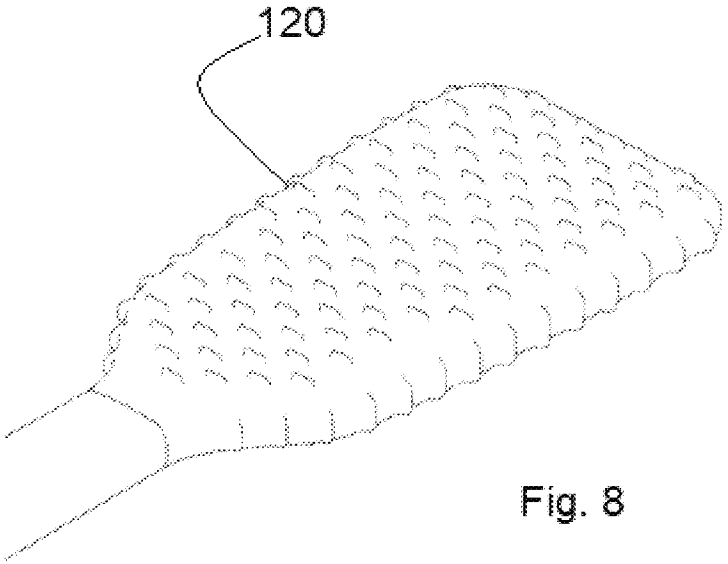
FIG. 8 is a first blade view of a manipulable hygiene device in accordance with one embodiment of the present invention.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

As used herein, first, second, and third directions are mutually orthogonal and may include X, Y, and Z axis mutually orthogonal directions.

As used herein, an axial direction may include a direction along the X, Y, or Z axis mutually orthogonal directions.

As used herein, a manipulable hygiene device is a device which may be manipulated by a user either manually or automatically as a powered device for the purpose of a hygiene activity. Said hygiene activities may include, but are not limited to brushing, scaling, cleaning, buffing, smoothing, rubbing, massaging, stimulating, shaving, scraping, squeegee, depilatories, wiping, spreading, and similar devices employing abrasion or frictional actions.

Referring now to FIG. 1 a manipulable hygiene device 100 is shown. The manipulable hygiene device 100 includes an elongated stem 110 which is positioned between a plurality of opposing blades 120 and 130. The elongated stem 110 has a substantially constant width W110 along an elongated axial direction X. A first blade 120 is attached to a proximal end of the elongated stem 110. The first blade 120 has a varying width W120 along the elongated axial direction X. A second blade is attached to a distal end of the elongated stem 110. The second blade 130 has a varying width W130 along the elongated axial direction X. In addition, the first blade 120 and the second blade 130 have a plurality of at least four surfaces respectively including at least an upper surface, a lower surface, a left surface and a right surface for each of said first and second blades 120, 130, where various blade surfaces are depicted throughout the various views of FIGS. 1-8. Moreover, each of the plurality of first and second respective blade surfaces further includes an array of minute protruding structures 121, 131, 331 which are distributed across substantially the entire surface area of each of the plurality of first and second respective blade surfaces such that each array of minute protruding structures 121, 131, 331 forms a collection of abrasive surfaces having varied contoured dimensions in a manipulable hygiene device 100. This collection of abrasive surfaces having varied contoured dimensions may be operated by a user as manipulable for abrasive hygiene of the user, another person, or an animal. The manipulable hygiene device 100 is thus formed with contoured dimensions and surface to facilitate abrasive hygiene activities which may include, but are not limited to brushing, scaling, cleaning, buffing, smoothing, rubbing, massaging, stimulating, shaving, scraping, squeegee, depilatories, wiping, spreading, and similar activities employing abrasion or frictional actions.

Continuing in FIG. 1, the width of each of the first blade 120 having a varying width W120 along the elongated axial direction X and the second blade 130 having a varying width W130 along the elongated axial direction X have their respective smallest widths, that is their narrowest widths, adjacent to their respective attachment ends of elongated stem 110.

As depicted in FIG. 1, a width of the first blade 120 having a varying width W120 along the elongated axial direction X varies to a greater extent and is thus wider in a more positive axial direction X than a width of the second blade 130 also having a varying width W130, but W130 is relatively narrower in a negative axial direction X.

Referring again to FIG. 1 and also to FIG. 2, the array of minute protruding structures 121, 131, 331 which are distributed across substantially the entire surface area of each of the plurality of first and second respective blade 120, 130 surfaces are arranged in one embodiment in an array of rows and columns wherein each row is positionally offset from a set of the most adjacent rows and each column is offset from a set of the most adjacent columns.

In another embodiment, the array of minute protruding structures 121, 131, 331 distributed across substantially the entire surface area of each of the plurality of first and second respective blade 120, 130 surfaces are arranged in an array of randomly distributed positions with respect to adjacent minute protruding structures 121, 131, 331.

Moreover, as shown throughout FIGS. 1-8, the array of minute protruding structures 121, 131, 331 which are distributed across substantially the entire surface area of each of the plurality of first and second respective blade surfaces may each have any type of polygonal cross-sectional area such as square, rectangular, trapezoidal, pentagonal, hexagonal, triangular, etc. whether regular or irregular polygonal cross-sectional areas. In addition, the array of minute protruding structures 121, 131, 331 may each have any type of arcuate cross-sectional area, including circular, semicircular and various regular or irregular arcuate cross-sections.

Referring now to FIGS. 4 and 5, in certain embodiments, the first blade 120 and the second blade 130 may be aligned in the elongated axial direction X such that the plurality of opposing blades 120 and 130 lie within the same plane as the elongated stem 110.

Referring now to FIGS. 3 and 6, in certain embodiments, the first blade 120 and the second blade 130 may be offset with respect to the elongated axial direction X such that at least one of the plurality of opposing blades 120 and 130 does not lie within the same plane as the elongated stem.

Referring now to FIGS. 3 and 7, in certain embodiments, either the first blade 120, the second blade 130, or both blades may be formed as convex (for example along 332 in FIG. 3) or concave (not shown) in an orthogonal direction with respect to the elongated axial direction X.

Referring again to FIGS. 3 and 7, in certain embodiments, either the first blade 120, the second blade 130, or both blades may be formed as substantially convex, concave, or planar in profile in an orthogonal direction with respect to the elongated axial direction X, and additionally the array of minute protruding structures 121, 131, 331 which are distributed across substantially the entire surface area of each of the plurality of first and second respective blade surfaces may protrude orthogonally from the respective blade surfaces (see the minute protruding structures 331 which are distributed across substantially the entire surface area of the second blade 130, as shown in an exemplary embodiment of FIG. 3) having substantially convex, concave, or planar profiles. In the configuration of this embodiment as best shown in FIGS. 3 and 7, the abrasive contact area is enhanced during abrasive hygiene activities due to the collection of abrasive surfaces having varied contoured dimensions which are positioned along an inner convex surface of the second blade 130.

While the present invention has been illustrated by the description of exemplary embodiments thereof, and while the embodiments have been described in certain detail, there is no intention to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the general inventive concept.

The invention claimed is:

1. A manipulable hygiene device comprising: an elongated stem positioned between a plurality of opposing blades, said elongated stem having a constant width along an elongated axial direction; the plurality of opposing blades including a first blade attached to a proximal end of said elongated stem, said first blade having a varying width along said elongated axial direction; and the plurality of opposing blades including a second blade attached to a distal end of said elongated stem, said second blade having a varying width along said elongated axial direction; wherein said first blade has a plurality of at least four surfaces respectively including at least an upper surface, a lower surface, a left surface and a right surface for said first blade; and wherein said second blade has a plurality of at least four surfaces respectively including at least an upper surface, a lower surface, a left surface and a right surface for said second blade; and each of the plurality of at least four surfaces respectively of the first blade and each of the plurality of at least four surfaces respectively of the second blade further includes an array of minute protruding structures distributed across the entire surface area of each of the plurality of at least four surfaces respectively of the first blade and each of the plurality of at least four surfaces respectively of the second blade such that each array of minute protruding structures forms a collection of abrasive surfaces having varied contoured dimensions in a manipulable hygiene device; and in an endview of the first blade of said manipulable hygiene device, a height between the upper surface and the lower surface adjacent to the left surface is not equal to a height between the upper surface and the lower surface adjacent to the right surface, and an endview of the second blade is concave having a V-shaped profile, said device manipulable by a user for abrasive hygiene.

2. The manipulable hygiene device of claim 1 wherein said width of each of said first blade having the varying width along said elongated axial direction and said second blade having the varying width along said elongated axial direction have their respective smallest widths adjacent to their respective attachment ends of said elongated stem.

3. The manipulable hygiene device of claim 1 wherein the first blade has a greater width than the second blade.

4. The manipulable hygiene device of claim 1 wherein said array of minute protruding structures distributed across the entire surface area of each of the plurality of at least four surfaces respectively of the first blade and each of the plurality of at least four surfaces respectively of the second blade are arranged in an array of rows and columns wherein each row is positionally offset from a set of most adjacent rows and each column is offset from a set of most adjacent columns.

5. The manipulable hygiene device of claim 1 wherein said array of minute protruding structures distributed across the entire surface area of each of the plurality of at least four surfaces respectively of the first blade and each of the plurality of at least four surfaces respectively of the second blade are arranged in an array of randomly distributed positions with respect to adjacent minute protruding structures.

6. The manipulable hygiene device of claim 1 wherein said array of minute protruding structures distributed across the entire surface area of each of the plurality of at least four surfaces respectively of the first blade and each of the plurality of at least four surfaces respectively of the second blade each have a polygonal or an arcuate cross-sectional area.

7. The manipulable hygiene device of claim 1 wherein the plurality of opposing blades including the first blade and the second blade are aligned in the elongated axial direction such that said plurality of opposing blades lie within the same plane as said elongated stem.

8. The manipulable hygiene device of claim 1 wherein the plurality of opposing blades including the first blade and the second blade are offset with respect to the elongated axial direction such that at least one portion of said plurality of opposing blades does not lie within the same plane as said elongated stem.

* * * * *